US006280160B1

(12) United States Patent
Nothdurft et al.

(10) Patent No.: US 6,280,160 B1
(45) Date of Patent: Aug. 28, 2001

(54) DISTRIBUTOR-TYPE FUEL INJECTION PUMP

(75) Inventors: Heinz Nothdurft; Nestor Rodriguez-Amaya; Andreas Dutt, all of Stuttgart; Hubert Greif, Markgroeningen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/202,928

(22) PCT Filed: Feb. 20, 1998

(86) PCT No.: PCT/DE98/00507

§ 371 Date: Dec. 9, 1999

§ 102(e) Date: Dec. 9, 1999

(87) PCT Pub. No.: WO98/49441

PCT Pub. Date: May 11, 1998

(30) Foreign Application Priority Data

Apr. 25, 1997 (DE) ..... 197 17 494

(51) Int. Cl.[7] ..... F04B 39/00

(52) U.S. Cl. ..... 417/462; 417/486; 417/505; 123/450; 123/506

(58) Field of Search ..... 417/462, 486, 417/487, 505; 123/450, 506

(56) References Cited

U.S. PATENT DOCUMENTS 3,547,092 * 12/1970 Knight ..... 123/450
4,125,104 * 11/1978 Stein ..... 417/462
4,453,896 * 6/1984 Vilardo et al. ..... 417/462
4,492,534 * 1/1985 Miyaki et al. ..... 417/462
4,530,324 * 7/1985 Tanaka et al. ..... 417/462
4,573,442 * 3/1986 Matsumura et al. ..... 123/450
4,604,980 * 8/1986 Leblanc ..... 123/450
4,671,239 * 6/1987 Hishinuma et al. ..... 417/462
4,940,036 * 7/1990 Duplat ..... 123/506
5,215,060 * 6/1993 Klopfer et al. ..... 123/450
5,700,139 * 12/1997 Rodriguez-Amaya ..... 417/462

* cited by examiner

*Primary Examiner*—Cheryl J. Tyler
(74) *Attorney, Agent, or Firm*—Ronald E. Greigg; Edwin E. Greigg

(57) ABSTRACT

A fuel injection pump of the distributor type which has a reciprocatingly driven pump piston that is load-bearing in a rotating distributor shaft which pumps fuel out of a pump work chamber to various fuel injection valves via a distributor opening. To control the duration of high-pressure injection, an electrically actuated valve is provided with a valve member in a valve chamber that communicates with the pump work chamber and from a second valve chamber, communicates with a low-pressure region. To terminate the high-pressure injection, the valve member makes a communication between the two valve chambers, whereupon the outflow of the fuel stream is controlled by disposing a diameter constriction in the connecting line, thus reducing any tendency to cavitation.

20 Claims, 2 Drawing Sheets

DISTRIBUTOR-TYPE FUEL INJECTION PUMP

PRIOR ART

The invention is based on a fuel injection pump. In one such fuel injection pump, known from International Patent Disclosure WO 95/02760, a plurality of pump pistons located crosswise to the direction of rotation of the distributor are provided, in the manner of a radial piston pump with a pump work chamber enclosed between them. The connecting line used to supply fuel to the pump work chamber and to relieve it has a constant, unthrottled cross section in this known fuel injection pump. In these pumps, fuel is aspirated with the valve open over the entire intake stroke of the pump pistons, and the valve is then closed again to define the effective pumping stroke of the pump pistons. For a particular rotary angle range or time segment, the fuel injection pump then pumps fuel, which is brought to high injection pressure, to one fuel injection valve at a time, depending on the position of the distributor. To terminate this pumping or define the fuel injection quantity, the valve is opened again. In this process the pressure in the pump work chamber, which until now was at a very high level, such as 1000 to 1200 bar, is reduced via the valve opening to the low-pressure region, in that fuel flows out there and at the same time the remaining quantity pumped by the pump piston is forced out. In this relief, because of the major pressure difference between the high- and low-pressure region, flow separations and flow recirculation zones can arise, and gas bubbles are formed in the fuel which in regions of relatively high pressures upon the ensuing implosion lead to material damage and so-called cavitation erosion, especially in the vicinity of the surrounding walls. Over the long term, this can cause functional problems in the fuel injection pump, especially if these erosions extend to the valve seats themselves.

ADVANTAGES OF THE INVENTION

The fuel injection pump of the invention has the advantage over the prior art that because of the diameter constriction in the connecting line, the effects that trip cavitation erosion are suppressed. Because of the diameter constriction, the outflow of fuel is throttled to a certain extent or at least in such a way that the fuel flowing out via the valve opening is rapidly opposed by a certain counterpressure, so that beyond the valve seat the outflowing fuel cannot expand, which would allow an unfavorable flow and would allow gas bubbles to form in the fuel. Before a continuous flow has built up in the outflow direction via the connecting line, the diameter constriction instantaneously makes a high throttling action available, which leads to a rapid pressure buildup in the second valve chamber.

In a further advantageous feature, the connecting line is oriented with its axis in the direction of the valve member, so that in this way a fuel exchange between the low-pressure region and the pump work chamber and vice versa can be effected in a streamlined way. Especially advantageously, in, the diameter constriction is designed such that it promotes a flow of fuel from the low-pressure region to the valve opening or the pump work chamber. The funnel-like design assures that the pump work chamber is supplied adequately and quickly with fuel during the intake phase of the distributor injection pump, without the diameter constriction having a harmful effect on the extent to which the pump work chamber is filled. Advantageously, the transitions on the inflow side to the pump work chamber can also be rounded. The embodiment as a diffusor allows further improvement in flow conditions. In the opposite direction, that is, for the emergence of fuel from the pump work chamber toward the low-pressure region, such provisions are not contemplated, in particular so that the initial throttling, while the flow through the connecting line has not yet been established, will be preserved in order to reduce the development of gas bubbles.

In a further advantageous feature, a plurality of connecting lines are provided, so that the above-described instantaneous counterpressure can build up uniformly to terminate the high-pressure injection directly after the reopening of the valve member, thus averting the formation of insular areas of gas bubbles. It is advantageous in this respect if one of the connecting lines is disposed opposite the pressure conduit leading away from the first valve chamber, so that the quantity of fuel flowing from the first pressure conduit into the second valve chamber via the valve opening will directly meet the throttled outlet from one of the connecting lines. In all cases, for forming the counterpressure it is important for a compensation piston to be disposed on the valve closing member, connected to the valve closing member vi a connecting tang and together with the second valve chamber forming an annular chamber. The chamber thus enclosed promotes the development of counterpressure and thus serves to reduce the tendency to cavitation.

BRIEF DESCRIPTION OF THE DRAWINGS

One exemplary embodiment of the invention is shown in the drawing and will be described in further detail below.

DESCRIPTION OF THE EXEMPLARY EMBODIMENT

Figure 1:
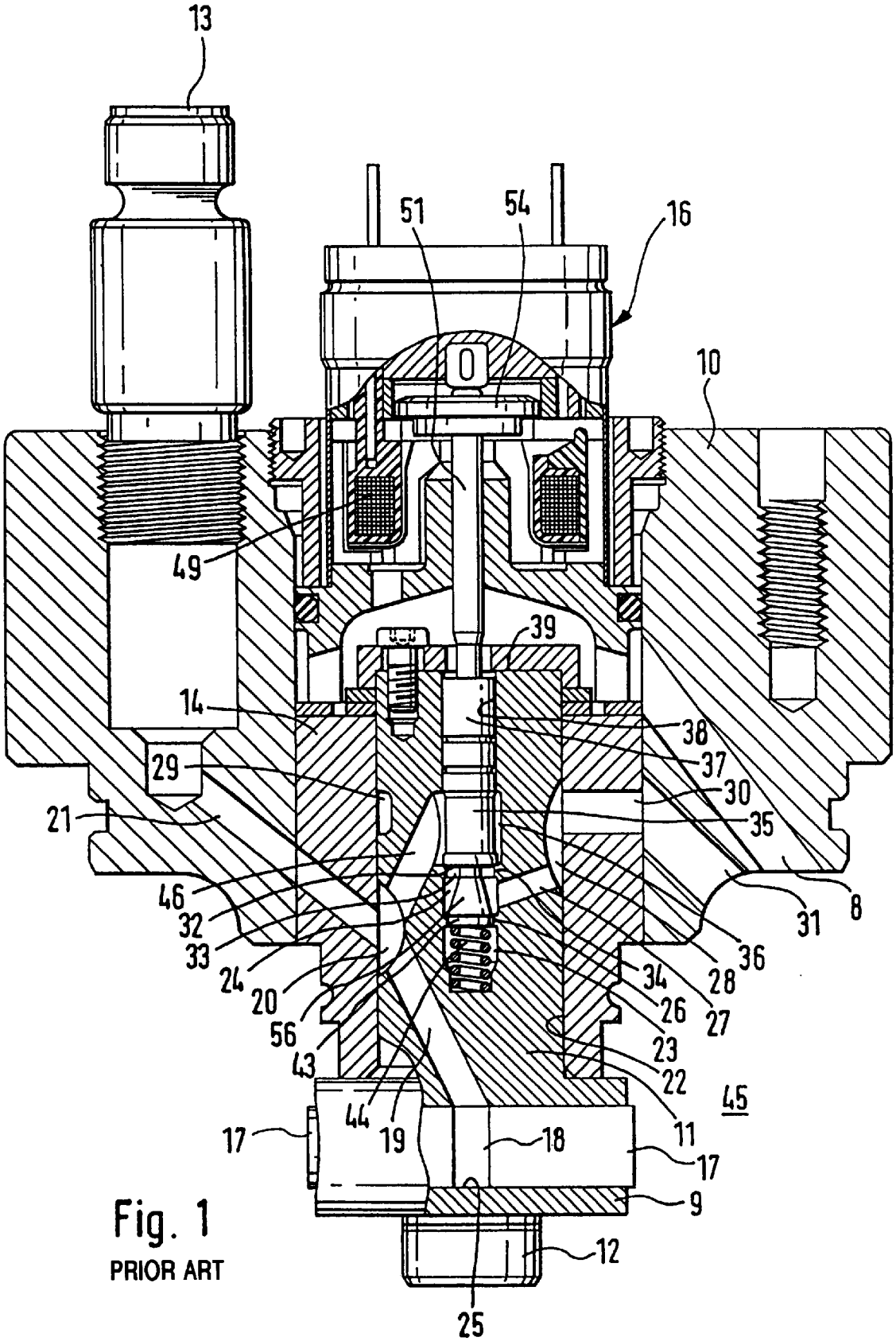
Fig. 1 PRIOR ART
FIG. 1 shows a section through a distributor injection pump in accordance with the standard technology.

The fuel injection pump of the distributor type, shown in longitudinal section in fragmentary form in FIG. 1 of the drawing has a pump housing, not visible here, that is closed off in liquid-tight fashion by a pump head 10. A low-pressure region 45, not described further, is thus enclosed between the pump housing and the pump head and is at the same time a low-pressure supply region. A cylinder liner 14 is inserted into the pump head 10 and serves with its inner bore 22 to support a distributor shaft 11. The distributor shaft is driven to rotate by a drive shaft, not further shown, via a slaving means 12 and is supported so as to be fixed in the axial direction. In the region of a collar 9 protruding into the low-pressure region 45, there is at least one transverse bore 25, in which pump pistons 17 that between them enclose a pump work chamber 18 are supported. The pump pistons are driven to execute a supply stroke inward in the direction of the pump chamber 18 by a cam ring, not shown further here, that circumferentially surrounds them, and they can execute an intake stroke, moving outward on an outward edge of the cam. The pump work chamber 18 communicates continuously via a feed line 19 with a distributor opening 20 in the jacket face of the distributor shaft and is normally covered by the jacket face of the inner bore 22 of the cylinder liner 14. In the region of this distributor opening, injection lines 21 lead with a rotational angle offset away from the inner bore 22 of the cylinder line and optionally communicate via a pressure valve 13 with fuel injection valves, not shown further here.

Also leading away from the distributor opening 20 is a pressure conduit 46 to a first valve chamber 36, which surrounds part of a valve member 35. The valve member has a guide part 37 that is guided in a guide bore part 38, and this guide bore part 38 is part of a recess made coaxially into the distributor shaft from its face end 39. The valve member 35 is axially movable in the guide part 37 and with the guide part 37 closes off the first valve chamber 36, adjoining the guide bore part 38, from the outside. It should be pointed out in this respect that the part of the distributor shaft that carries the face end 39 protrudes out of the cylinder liner and adjoins the low-pressure region. An electromagnetic actuating member 16 is located on this side of the cylinder line 14 or distributor shaft 11; it has an armature 54, a magnet coil 49, which upon being excited pulls this armature against a magnet core, and a tappet 51, which is connected to the armature 54 and acts coaxially on the valve member 35. The housing of the electromagnetic actuating member 16, together with the distributor shaft and the cylinder liner 14, encloses a chamber in the pump head 10 that communicates constantly with the low-pressure region 45 via a conduit 8.

The valve member 35 has a valve sealing face 32, which comes to rest on a valve seat 34 under the influence of the magnetic force of the electromagnetic actuating member 16. In this process the valve member closes a valve opening 32, surrounded by the valve seat 34, that forms the communication between the first valve chamber 36 and a second valve chamber 24. In the closing direction of the valve member 35, this second valve chamber 24 is defined on one side by the valve member 35 and on the other by a compensation piston 43, which slides in a guide 26 adjoining the second valve chamber 24 and on its face end defines a spring chamber 23, in which a spring 44 is disposed that urges the valve member 35 in the opening direction. The spring chamber is pressure-relieved, in a manner not shown in further detail. Via a connecting tang 56, the compensation piston 43 is integrally connected to the valve member 35 in such a way that the second valve chamber is in the form of an annular chamber. From it, a connecting line 27 leads via a longitudinal groove 28 to an annular groove 29 in the jacket face of the distributor shaft, which in turn communicates constantly with a radial bore 30 in the cylinder line 40, which communicates with a bore 31 discharging into the low-pressure region 45. The second valve chamber 24 is thus constantly relieved to the low-pressure region 45.

In operation of the distributor injection pump, the valve member 35 is open during the intake stroke of the pump pistons 17, so that via the above-described communication, fuel can flow out of the low-pressure region 45 via the first valve chamber 36, the pressure conduit 46, the distributor opening 20 and the feed line 19, to reach the pump work chamber 18. Beyond a certain time in the inward motion of the pump pistons 17, which is the desired injection onset, the valve member 35 is closed by the electromagnetic actuating member 16. The fuel volume now enclosed in the pump work chamber 18 is brought to high pressure and consequently fed to one of the injection lines 21 via the pressure line 19 and the distributor opening 20. To terminate the injection or define the injection quantity, the valve member 35 is returned to the opening state, which is done by interrupting the supply of current to the electromagnetic actuating member 16. From this time on, the pressure in the pump work chamber 18 can decrease toward the second valve chamber 24 and from there toward the low-pressure region 45.

Figure 2:
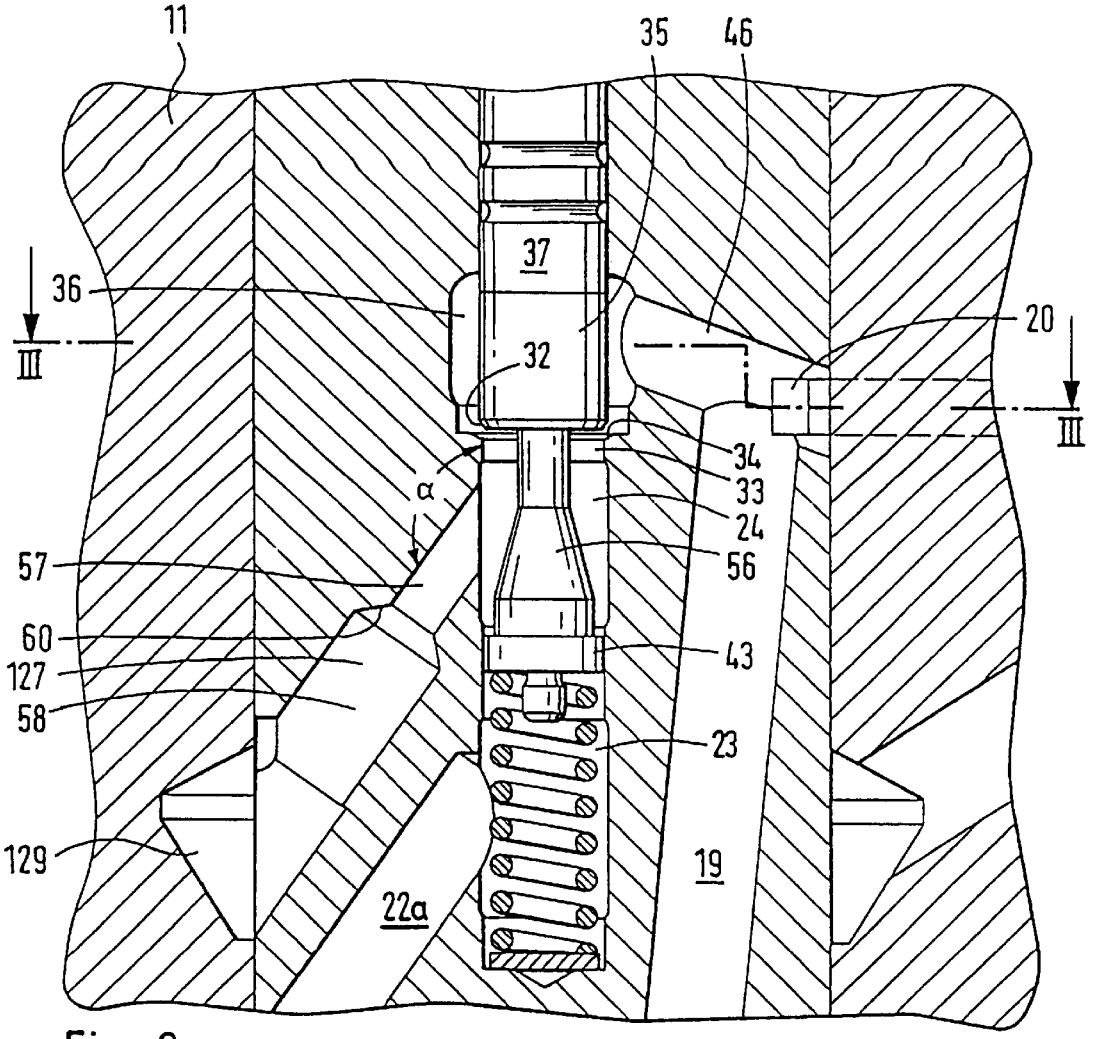
FIG. 2 is a partial cross sectional view of the essential part of an electrically controlled switching valve with a disposition according to the invention of an embodiment of a connecting line.

In FIG. 2, the embodiment according to the invention is now shown in further detail. Once again, in FIG. 2 the guide part 37 of the valve member 35 and the first valve chamber 36 that annularly surrounds this valve member 35 and is defined by the valve seat 34 on the side remote from the guide part 38 can be seen. Once again, the pressure conduit 46 leads away from the first valve chamber 36 to the distributor opening 20. The connecting line 27 of FIG. 1 is now called the connecting line 127. It extends obliquely upward in the drawing in the direction of the valve opening 33 and, with the wall toward the valve seat of the second valve chamber 24, forms an angle $\alpha$ a which is greater than 90°. In the preferred exemplary embodiment shown here, this angle is approximately 135°. The extension of the axis of the connecting line points approximately through the valve opening 33 to the discharge point of the pressure conduit 46 into the first valve chamber 36. The discharge point of the connecting line 127 into the second valve chamber is located approximately halfway along the length thereof between the valve seat 34, or valve sealing face 32, and the compensation piston 43. The special feature in this connecting line embodied as a conduit is that from an initially larger diameter, it changes over toward the second valve chamber 24 into a diameter constriction 57, which discharges directly, with a then constant diameter, into the second valve chamber 24. A transition 60 is provided between the diameter constriction 57 and the larger-diameter part 58 of the connecting line 127; in the example shown, the transition is embodied pointing in funnel-like fashion toward the second valve chamber 24. The angular version shown here may also be provided with rounded transitions. This transition 60 and the diameter constriction 57 may also be embodied in diffusor-like fashion, that is, with streamlined continuous transitions to the larger diameter in the outflow direction. In all flow directions, such a diffusor furnishes a streamlined introduction of liquid.

The connecting line 127 communicates constantly with an annular groove 129, which corresponds to the annular groove 29 of FIG. 1 but is now made in the jacket face of the cylinder line 14 and also communicates constantly with the low-pressure region 45. In the same way, the spring chamber 23 shown in FIG. 2 has a connection 22*a* shown now leading to a conduit, not shown, that leads out of the pump.

Figure 3:
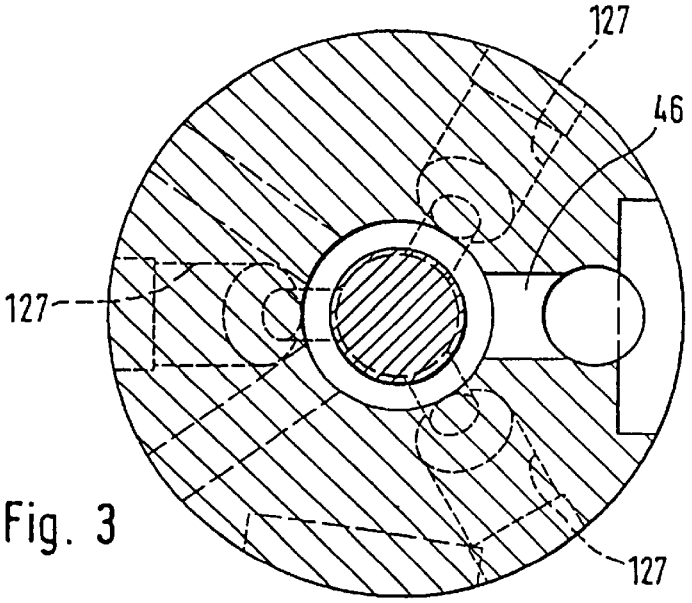
FIG. 3, is a section through the exemplary embodiment of FIG. 2 taken along the line III—III.

It can be seen from the section in FIG. 3 that not merely one connecting line 127 but rather three connecting lines are provided, spaced apart by the same angles. The discharge points of the diameter constrictions 57 are located in a common radial plane to the axis of the distributor shaft. One of these connecting lines 127, as can be seen here, is located in a radial plane opposite the discharge point of the pressure conduit. These discharge points are naturally axially offset from one another, since they open into different valve chambers.

With this embodiment, it is attained that upon an opening of the valve member 35, fuel flows over at high pressure out of the first valve chamber 36 into the gap between the valve sealing face 32 and the valve seat 34 into the second valve chamber 24. This flow has the tendency of uneven distribution of the overflow speeds, which results from the geometry of the first valve chamber 36 having the single discharge point of the pressure conduit 46. This kind of pronounced flow profile can cause turbulence to develop inside the second valve chamber 24, which is especially true if a quite low pressure prevails there and persists for a long time, with a large outflow cross section of the kind that may be favorable for adequate filling of the pump work chamber.

However, because the diameter constriction 57 is now provided, it initially acts as a high flow resistance, before a stable outflowing fuel stream can develop through this diameter constriction, in such a way that initially a certain pressure level has to build up in the second valve chamber 24, by means of the fuel flowing in via the valve seat. This causes a rapid pressure buildup there and counteracts the relief of the fuel as it flows over from a high pressure level to a low pressure level, in such a way that turbulent flows and isolated instances of outgassing within the second valve chamber 24 are avoided. Once an adequately high pressure has built up in the second valve chamber, the stable, regular outflow of fuel then occurs through the diameter constriction 57, resulting in a further pressure relief in the region of the larger-diameter part 58 of the connecting line 127 toward the low-pressure region 45. As soon as this flow has developed, at the same time the risk of formations of gas nests in the second valve chamber 24 is averted, which thus also prevents the risk of cavitation erosion. By uniform throttling on all sides of the outflow, as a consequence of the uniformly distributed low-pressure lines, a symmetrical pressure buildup is promoted, which favors a relatively ordered flow in the low-pressure region and in particular the formation of protective recirculation flows along the walls of the low-pressure region, which keep outgassing components away from the walls of the low-pressure region and the valve seat 34, if such outgassing even occurs at all.

The cross sections of the diameter constrictions are dimensioned such that in the filling mode of the pump work chamber, an adequate inflow cross section is available, and the pump work chamber can also be adequately intake stroke filled. The high wall portion of the inflow, which now comprises a plurality of bores, favors the initial rapid pressure buildup in the case where the pump work chamber is being relieved.

In this way, by a simple but effective provision, the fuel injection pump is guarded quite substantially against possible cavitation erosion.

The foregoing relates to a preferred exemplary embodiment of the invention, it being understood that other variants and embodiments thereof are possible within the spirit and scope of the invention, the latter being defined by the appended claims.

What is claimed is:

1. A fuel injection pump of the distributor type for supplying a plurality of fuel injection valves of an internal combustion engine, comprising at least one reciprocatingly driven pump piston (17) that defines a pump work chamber (18) and upon each supply stroke pumps fuel at injection pressure out of this pump work chamber to one of the fuel injection valves, a rotationally driven distributor shaft (11) that upon rotation in the supply stroke of the pump piston (18) establishes communication, via a distributor opening (20) on the circumference of the distributor shaft which communicates constantly with the pump work chamber, between the pump work chamber (18) and a fuel injection valve, and having an electrically controlled switching valve (16) which serves to control fuel injection over a course of the supply stroke of the pump piston (17) and has a valve member (35) that controls a valve opening (33) between a first valve chamber (36) and a second valve chamber (24), wherein the first valve chamber (36) communicates constantly with the distributor opening (20) via a pressure conduit (46) and a connecting line (127) leads from the second valve chamber (24) to a fuel-filled low-pressure chamber (45) and both the filling and relieving of the pump work chamber (18) are effected via this connecting line (127), the second valve chamber (24) adjoins a valve seat (34) of the valve member (35) and is disposed in the distributor shaft (11) coaxially to the axis of the distributor shaft, and the connecting line (127) has a diameter constriction (57).

2. The fuel injection pump according to claim 1, in which the connecting line (127) leads away from the second valve chamber (24) in such a way that with a part of a wall of the distributor shaft toward the valve seat, of the second valve chamber the connecting line forms an angle greater than 90°.

3. The fuel injection pump according to claim 2, in which a transition, located to a side of the low-pressure region (45), between the diameter constriction (57) and the larger-diameter part (58) of the connecting line (127) narrows in funnel-like fashion toward the second valve chamber (24).

4. The fuel injection pump according to claim 2, in which three connecting lines (127) are provided, with outlet openings located in a common radial plane to one of the axis of the distributor shaft (11) and the second valve chamber (24) and are spaced apart by equal angles from one another.

5. The fuel injection pump according to claim 2, in which the second valve chamber (24) on a side remote from the valve seat (34) is defined by a compensation piston (43), which is connected to the valve closing member (35) via a connecting tang (56) and on another side adjoins a pressure-relieved chamber (23).

6. The fuel injection pump according to claim 1, in which a transition, located to a side of the low-pressure region (45), between the diameter constriction (57) and the larger-diameter part (58) of the connecting line (127) narrows in funnel-like fashion toward the second valve chamber (24).

7. The fuel injection pump according claim 6, in which the transition is provided with rounded transition regions.

8. The fuel injection pump according to claim 7, in which a diameter of the constriction (57) discharges directly into the second valve chamber (24).

9. The fuel injection pump according to claim 6, in which the transition pointing toward the low-pressure side is a diffusor.

10. The fuel injection pump according to claim 9, in which a diameter of the constriction (57) discharges directly into the second valve chamber (24).

11. The fuel injection pump according to claim 6, in which a diameter of the constriction (57) discharges directly into the second valve chamber (24).

12. The fuel injection pump according to claim 6, in which three connecting lines (127) are provided, with outlet openings located in common radial plane to one of the axis of the distributor shaft (11) and the second valve chamber (24) and are spaced apart by equal angles from one another.

13. The fuel injection pump according to claim 2, in which the second valve chamber (24) on a side remote from the valve seat (34) is defined by a compensation piston (43), which is connected to the valve closing member (35) via a connecting tang (56) and on another side adjoins a pressure-relieved chamber (23).

14. The fuel injection pump according to claim 1, in which a plurality of connecting lines (127) distributed over the circumference of the second valve chamber (24) lead away from the second valve chamber.

15. The fuel injection pump according to claim 14, in which the connecting lines (127) are spaced apart by equal angles from one another.

16. The fuel injection pump according to claim 15, in which one of the connecting lines (127) is located in a radial plane, opposite the pressure conduit (46) leading away from the first valve chamber (36).

17. The fuel injection pump according to claim 1, in which three connecting lines (127) are provided, with outlet openings located in common radial plane to one of the axis of the distributor shaft (11) and the second valve chamber (24) and are spaced apart by equal angles from one another.

18. A fuel injection pump according to claim 1, in which the valve member (35) is a seat valve, with a valve seat (34) oriented toward the first valve chamber (36).

19. The fuel injection pump according to claim 1, in which the second valve chamber (24) on a side remote from the valve seat (34) is defined by a compensation piston (43), which is connected to the valve closing member (35) via a connecting tang (56) and on another side adjoins a pressure-relieved chamber (23).

20. The fuel injection pump according to claim 19, in which the valve chamber (35) is urged in an opening direction by a compression spring (44), and the compression spring engages a side of the compensation piston (43) remote from the second valve chamber (24).

* * * * *